US005933886A

United States Patent [19]

Washington

[11] Patent Number: 5,933,886

[45] Date of Patent: Aug. 10, 1999

[54] BABY BLANKET

[76] Inventor: Tarsha M. Washington, 9437 Riverbrink Ct., Laurel, Md. 20723

[21] Appl. No.: 09/164,318

[22] Filed: Oct. 1, 1998

[51] Int. Cl.[6] ..... A47G 9/00

[52] U.S. Cl. ..... 5/494; 5/413 R; 5/482; D6/598; D6/603

[58] Field of Search ..... 5/494, 482, 413 R, 5/655, 500, 502; D6/603, 598; 2/69, 69.5

[56] References Cited

U.S. PATENT DOCUMENTS

| | | | |
|---|---|---|---|
| 2,419,989 | 5/1947 | Day . | |
| 2,961,668 | 11/1960 | Hayes | 5/636 |
| 3,987,505 | 10/1976 | Hickey . | |
| 4,062,076 | 12/1977 | Albertson | 5/482 |
| 4,316,287 | 2/1982 | Rule | 5/413 R |
| 4,597,121 | 7/1986 | Bouma | 5/494 |
| 4,653,131 | 3/1987 | Diehl | 5/494 |
| 4,856,131 | 8/1989 | Mills | 5/413 R |
| 4,862,535 | 9/1989 | Roberts | 5/494 |
| 5,093,947 | 3/1992 | Henegar et al. | 5/413 R |
| 5,193,235 | 3/1993 | Kircher | 5/494 |

FOREIGN PATENT DOCUMENTS

| | | | |
|---|---|---|---|
| 1338622 | 11/1973 | United Kingdom | 5/494 |

*Primary Examiner*—Alex Grosz
*Attorney, Agent, or Firm*—Stephen R. Greiner

[57] ABSTRACT

A blanket for snugly engaging the body of a baby. The blanket includes a bottom portion having: a head end, a leg end, a torso section lying between the head end and the leg end, and a pair of arms extending from the opposite sides of the torso section. The arms have releasable fasteners for joining the arms together. A top portion covers the leg end and the torso section of the bottom portion when placed in registration therewith. The top portion has a pair of slots for receiving the arms of the bottom portion so that, when the releasable fasteners are joined together, the top and bottom portions may be secured around a baby.

11 Claims, 2 Drawing Sheets

10
14
22
24
12
28
46
40
28
3
3
50
20
38
56
26
48
18
26
44
42

BABY BLANKET

FIELD OF THE INVENTION

The present invention relates generally to beds and, in particular, to bedclothing having means to engage the body of a user so as to ensure the proper covering of the body.

BACKGROUND OF THE INVENTION

The typical baby blanket, being merely a small piece of soft cloth, is often pushed aside by the normal movements of a baby, leaving the baby uncovered. Thus, to prevent a baby from being exposed to cold air while sleeping, parents will sometimes tightly wrap a child in a blanket to limit his or her movement. Sometimes this practice is found by the baby to be uncomfortable and the perceived distress may be communicated by prolonged crying.

SUMMARY OF THE INVENTION

In light of the problems associated with conventional, baby blankets, it is a principal object of the invention to provide an improved baby blanket which will keep a baby covered as long as desired yet will permit the relatively free and natural movement of the baby's limbs.

It is another object of the invention to provide a baby blanket of the type described which hugs and comforts a baby's torso while falling asleep or awakening.

Still another object of the invention is to provide a baby blanket which is waterproofed so as to prevent an underlying mattress from becoming inadvertently soiled during use.

It is an object of the invention to provide improved elements and arrangements thereof in a baby blanket for the purposes described which is lightweight in construction, inexpensive in manufacture, and dependable in use.

Briefly, the blanket in accordance with this invention achieves the intended objects by featuring a waterproof, bottom portion upon which a baby may be positioned. The bottom portion has an outline shaped like an animal with outstretched arms. The arms are provided with snap fasteners so that they can be joined together around the torso of a baby. A rectangular, top portion, formed of warm cloth, may be positioned atop a baby resting on the bottom portion. The top portion has slots for receiving the arms of the bottom portion so that, when the snap fasteners are joined together, the top and bottom portions may be secured around a baby.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
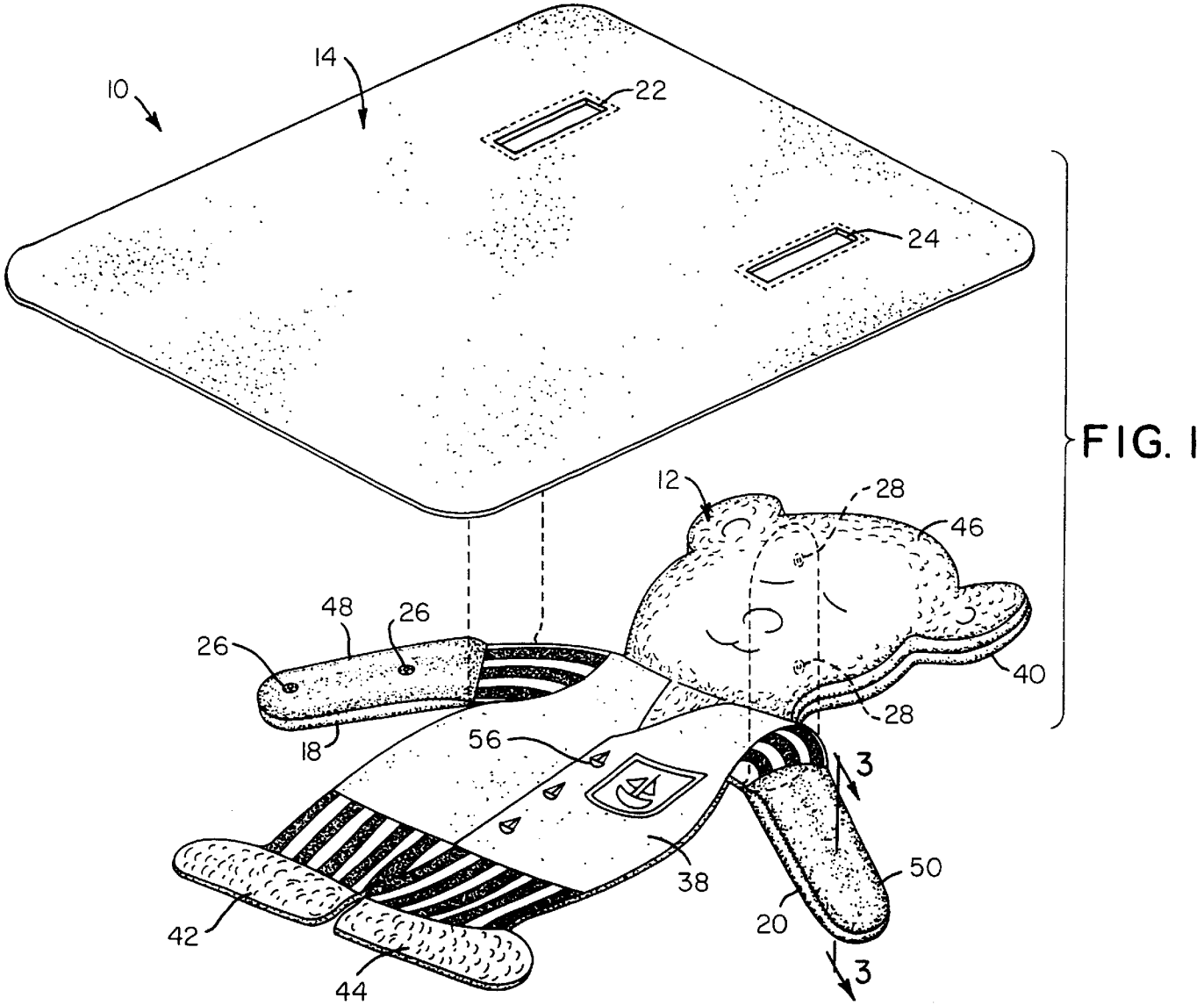
FIG. 1 is an exploded perspective view of a baby blanket in accordance with the present invention.
Figure 2:
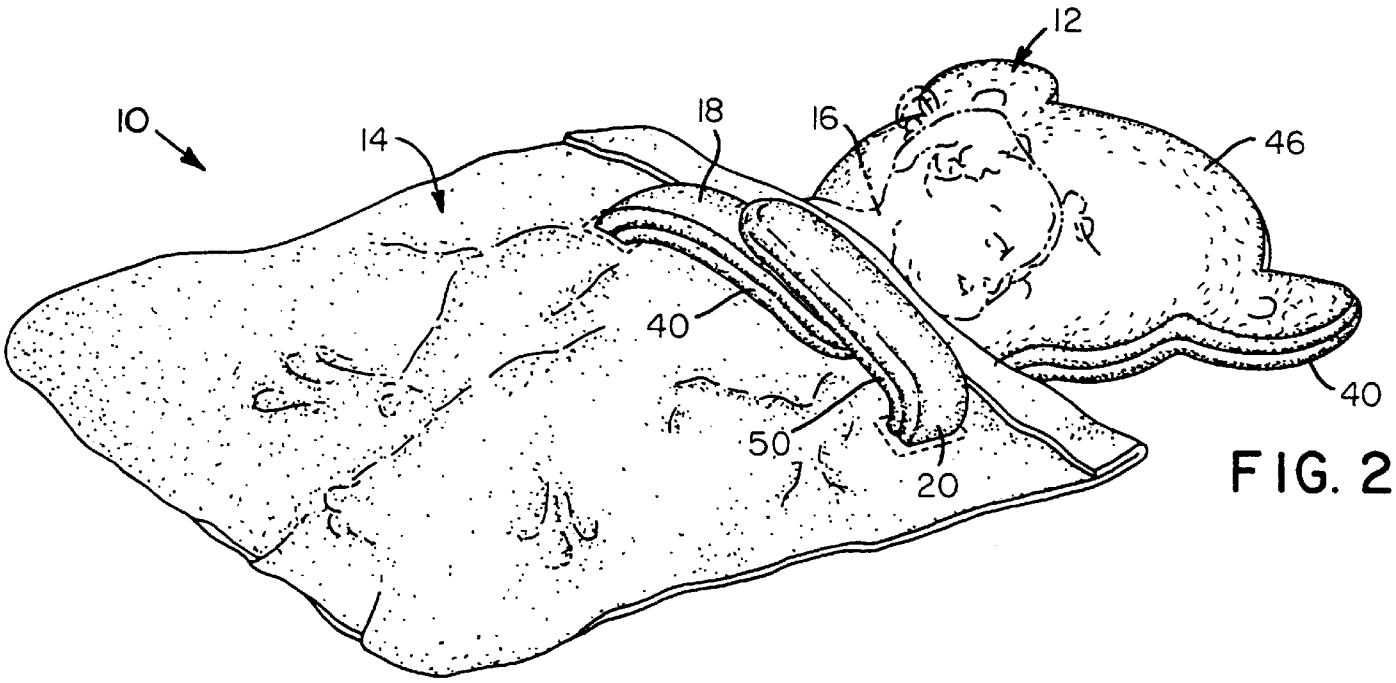
FIG. 2 is a perspective view of the baby blanket of FIG. 1 shown covering a baby.
Figure 3:
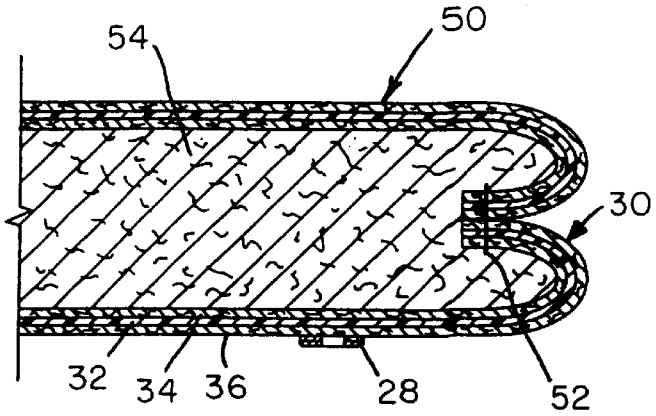
FIG. 3 is a cross-sectional view taken along line 3—3 of FIG. 1.

Referring now to the FIGS., a baby blanket in accordance with the present invention is shown at 10. The blanket 10 includes a bottom portion 12 and a top portion 14 between which a baby 16 may be positioned. The bottom portion 12 has arms 18 and 20 adapted to be extended through slots 22 and 24 in the top portion 14. When snap fasteners 26 and 28, secured to the arms 18 and 20, are joined together, the bottom portion 12 and top portion 14 may be secured around the baby 16.

The bottom portion 12 comprises a flexible sheet 30 having an impermeable, plastic layer 32 sandwiched between cloth layers 34 and 36 for comfort. Preferably, the sheet 30 is provided with an outline like that of an animal lying on its back. Thus, the sheet 30 includes: a body 38, a head 40 and a pair of legs 42 and 44 extending from the opposite ends of the body, and a pair of arms 18 and 20 extending from the opposite sides of the body. The body 38, head 40, legs 42 and 44, and arms 18 and 20 are dimensioned to receive a corresponding part of the baby 16 and separate such from an underlying surface.

Overlays 46, 48 and 50, all preferably formed of the same material as the sheet 30, are respectively secured to the head 40 and arms 18 and 20 by sewn seams as shown at 52 to form three, cloth cases. These cloth cases are filled with a cotton or polyester batting 54 prior to completion of the seams 52. The batting 54 reinforces the head 40 and arms 18 and 20 to provide pillows for the baby 16 and reinforce the arms somewhat to reduce the possibility of the baby becoming tangled in them.

Indicia 56 may be woven, printed or otherwise affixed to the sheet 30 and overlays 46, 48 and 50 to provide the bottom portion 12 with an eye-appealing design. The design shown in the FIGS., is simulative, of course, of a sleeping bear in pajamas.

Snap fasteners 26 and 28 permit the arms 18 and 20 to be releasably joined together. As shown, the male-type, snap fasteners 26 are secured to the overlay 48. The female-type, snap fasteners 28 are secured to the bottom of the arm 20 in positions corresponding with those of the fasteners 26. When the arm 20 is folded over the body 38 and the overlay 48 is brought across the arm 20, the fasteners 26 and 28 may be releasably joined together by pressing such together. A slight pull releases the fasteners 26 and 28 from one another.

The top portion 14 is formed of thick, insulating cloth. The top portion 14 is preferably rectangular in outline and is dimensioned to cover most of the bottom portion 12, i.e., the body 38, the legs 42 and 44, about one-half of the head 40, and the arms 18 and 20 when such are folded over the body. Since the top portion 14 has a length approximately equal to the distance from the top of the head 40 to the bottom of the legs 42 and 44 and a width equal to about twice the width of the body 38, the top portion also extends beyond the sides and leg end of the bottom portion 12 SO that cold drafts cannot reach the baby 16 during normal use of the blanket 10.

The slots 22 and 24 are positioned in the top portion 14 adjacent one end thereof. The spacing between the slots 22 and 24 is equivalent to the width of the body 38 of the bottom portion 12. The length of each of the slots 22 and 24, however, is set for snug engagement with the arms 18 and 20 so that the baby 16 cannot put his own hand or arm into the slots 22 and 24 during use of the blanket 10.

Use of the blanket 10 is straightforward. The bottom portion 12 is first positioned atop a mattress or other surface suitable for supporting a napping baby. Next, the baby 16 is positioned on the bottom portion 12 with his head atop the head 40 and his torso on the body 38. Then, the top portion 14 is placed atop the baby 16 and the bottom portion 12, and the arms 18 and 20 are pulled through the slots 22 and 24. The snap fasteners 26 and 28 may now be joined together thereby securing the bottom portion 12 and top portion 14 around the baby 16. Of course, by reversing the steps outlined above, the baby 16 can be readily released from the blanket 10.

From the foregoing, it should be apparent that, during use, the weight of the baby 16 serves to anchor both the bottom portion 12 and top portion 14 upon a support surface such as a bed. The bottom portion 12 protects the support surface from spills. The top portion 14, on the other hand, covers the baby 16 yet permits relatively unimpeded movement of his limbs for great comfort. A feeling of added security is provided to the baby 16 by the arms 18 and 20 which extend loosely around the baby 16 and act like a mother's arms to hug the baby while falling asleep or awakening.

While the invention has been described with a high degree of particularity, it will be appreciated by those skilled in the art that modifications may be made thereto. For example, the snap fasteners 26 and 28 may be replaced by Velcro, buttons or other releasable fasteners. Furthermore, the bottom portion 12 and top portion 14 may be formed from any desired fabric, cloth or insulative sheeting. Therefore, it is to be understood that the present invention is not limited to the sole embodiment described above, but encompasses any and all embodiments within the scope of the following claims.

I claim:

1. A baby blanket, comprising:

a bottom portion having: a head end, a leg end, a torso section lying between said head end and said leg end, and a pair of arms extending from the opposite sides of said torso section, said arms having releasable fasteners for joining said arms together; and, a top portion sized to cover said leg end and said torso section of said bottom portion when placed in registration therewith, said top portion having a pair of slots for the passage of said arms.

2. The baby blanket according to claim 1 wherein said bottom portion is formed from an impermeable material.

3. The baby blanket according to claim 1 wherein said top portion is formed from cloth.

4. The baby blanket according to claim 1 wherein said releasable fasteners are snap fasteners.

5. The baby blanket according to claim 1 further comprising a first pillow formed at said head end of said bottom portion.

6. The baby blanket according to claim 1 further comprising a pair of second pillows respectively formed on each of said arms.

7. A baby blanket, comprising:

a bottom portion having: a head end, a leg end, a torso section lying between said head end and said leg end, and a pair of arms extending from the opposite sides of said torso section, said arms having releasable fasteners for joining said arms together;

a first pillow formed at said head end of said bottom portion;

a pair of second pillows respectively formed on each of said arms; and, a top portion sized to cover said leg end and said torso section of said bottom portion when placed in registration therewith, said top portion having a pair of slots for the passage of said arms.

8. The baby blanket according to claim 7 wherein said bottom portion is formed from an impermeable material.

9. The baby blanket according to claim 7 wherein said top portion is formed from cloth.

10. The baby blanket according to claim 7 wherein said releasable fasteners are snap fasteners.

11. A baby blanket, comprising:

a bottom portion formed of impermeable cloth having: a head end, a leg end, a torso section lying between said head end and said leg end, and a pair of arms extending from the opposite sides of said torso section, said arms having snap fasteners for joining said arms together;

a first pillow secured to said head end of said bottom portion;

a pair of second pillows respectively secured to each of said arms; and, a top portion formed of insulative cloth sized to cover said leg end and said torso section of said bottom portion when placed in registration therewith, said top portion having a pair of slots for the passage of said arms.

* * * * *